US009215537B2

(12) United States Patent
Menzl

(10) Patent No.: US 9,215,537 B2
(45) Date of Patent: Dec. 15, 2015

(54) HEARING AID AND METHOD OF IMPLANTING A HEARING AID

(75) Inventor: Stefan Menzl, Jona (CH)

(73) Assignee: Advanced Bionics AG, Stafa (CH)

( * ) Notice: Subject to any disclaimer, the term of this patent is extended or adjusted under 35 U.S.C. 154(b) by 414 days.

(21) Appl. No.: 13/635,076

(22) PCT Filed: Mar. 15, 2010

(86) PCT No.: PCT/EP2010/053257

§ 371 (c)(1),
(2), (4) Date: Sep. 17, 2012

(87) PCT Pub. No.: WO2011/113468

PCT Pub. Date: Sep. 22, 2011

(65) Prior Publication Data

US 2013/0006044 A1 Jan. 3, 2013

(51) Int. Cl.
*H04R 25/00* (2006.01)

(52) U.S. Cl.
CPC ..... *H04R 25/606* (2013.01)

(58) Field of Classification Search
CPC ..... H04R 25/606
USPC ..... 600/25; 128/897–899; 607/57
See application file for complete search history.

(56) References Cited

U.S. PATENT DOCUMENTS

| | | | | |
|---|---|---|---|---|
| 4,957,478 | A | 9/1990 | Maniglia | |
| 5,558,618 | A | 9/1996 | Maniglia | |
| 6,162,169 | A | 12/2000 | Leysieffer | |
| 6,735,318 | B2 * | 5/2004 | Cho | 381/326 |
| 6,875,166 | B2 * | 4/2005 | Kroll et al. | 600/25 |
| 2001/0016678 | A1 * | 8/2001 | Kennedy | 600/25 |
| 2002/0026091 | A1 | 2/2002 | Leysieffer | |
| 2007/0121980 | A1 * | 5/2007 | Menzl | 381/328 |
| 2010/0145135 | A1 * | 6/2010 | Ball et al. | 600/25 |

* cited by examiner

*Primary Examiner* — Christine H Matthews
*Assistant Examiner* — Sunita Reddy
(74) *Attorney, Agent, or Firm* — Roberts Mlotkowski Safran & Cole, P.C.; David S. Safran

(57) ABSTRACT

A hearing aid including a permanent magnet to be fixed at a patient's incus (26), an audio signal source (14), an audio signal processing unit (16) for processing audio signals from the audio signal source, a driver unit (18) including a coil (22) for generating a magnetic field (25) that vibrates the permanent magnet according to the processed audio signals in order to stimulate the patient's hearing, and a measurement arrangement (56, 58, 60) for measuring the magnetic coupling between the coil and the permanent magnet in order to adjust the position of the coil or the input signals to the coil provided by the driver unit.

24 Claims, 4 Drawing Sheets

HEARING AID AND METHOD OF IMPLANTING A HEARING AID

BACKGROUND OF THE INVENTION

1. Field of the Invention

The invention relates to a hearing aid, wherein a permanent magnet, which is fixed at the patient's incus and which is driven by a coil, is used for stimulating the patient's hearing by causing the ossicular chain to vibrate according to the output signals from the hearing aid signal processor.

2. Description of Related Art

An example of such type of hearing aid is described in U.S. Pat. No. 5,558,618, wherein the hearing aid comprises an external unit comprising a microphone, an audio signal amplifier and a radio frequency (RF) transmitter and an implantable unit comprising a RF receiver, a coil driver circuitry and the coil which drives the magnet. The coil is fixed at a casing which houses the electronic circuitry of the internal unit. The casing is mounted at a retaining member fixed at the patient's skull within an opening drilled into the temporal bone. The position of the casing—and hence the position of the coil—is adjusted by a spindle drive. Once the retaining member has been fixed and the magnet has been fixed to the incus, the spindle drive is rotated until the coil rests against the magnet. Then the threaded shaft of the spindle drive is rotated a predetermined number of turns corresponding to a one millimeter movement of the casing, thereby adjusting the gap, i.e. the distance, between the coil and the magnet. It is mentioned in U.S. Pat. No. 5,558,618 that alternatively the gap could be physically measured; however, no information is given how such alternative embodiment could be realized.

U.S. Pat. No. 4,957,478 relates to a partially implantable hearing aid comprising a permanent magnet fixed at the ossicular chain and an external unit comprising a microphone, an audio signal processing unit and a coil for driving the magnet, which external unit is to be inserted into the ear canal of the patient. It is suggested that the patient should adjust the distance between the magnet and the coil according to the perceived hearing improvement by manually moving the external unit within the ear canal.

SUMMARY OF THE INVENTION

It is an object of the invention to provide for a hearing aid comprising a magnet to be fixed at the incus, which provides for highly predictable performance. It is a further object of the invention to provide for a corresponding method for implanting such hearing aid.

The invention is beneficial in that, by providing the hearing aid with a measurement arrangement for measuring the magnetic coupling between the coil and the permanent magnet in order to adjust the position of the coil or the input signals to the coil provided by the driver unit measurement arrangement for measuring the magnetic coupling between the coil and the permanent magnet, the position of the coil or the input signals to the coil provided by the driver unit may be adjusted in order to minimize hearing aid performance deterioration due to an improper distance between the coil and the magnet.

According to one embodiment, the driver assembly forms part of an implantable unit and includes a fixation system for fixing the driver unit at the patient's skull relative to the permanent magnet, including means for manual fine adjustment of the coil to a final position, wherein the measurement arrangement acts as a distance measurement arrangement for measuring the distance between the coil and the permanent magnet. Thereby, the final position of the coil with regard to the magnet can be precisely and reliably controlled by the surgeon, while the need for separate distance measurement equipment is avoided. This embodiment allows for precise adjustment of the distance between the coil and the magnet in a relatively simple manner.

According to another embodiment, the driver assembly forms part of an in-the-ear (ITE) device which is adapted to be inserted into the user's ear canal, wherein the driver assembly includes means for adjusting the input signals to the coil provided by the driver unit according the measured magnetic coupling between the coil and the permanent magnet.

The measurement arrangement may comprise a signal generator for supplying a test signal to the driver unit and means for measuring the respective response signal of the coil. Preferably, the test signal is a pulse, but can also be a chirp or a train of pulses.

In the following, examples of the invention will be illustrated by reference to the accompanying drawings.

DETAILED DESCRIPTION OF THE INVENTION

Figure 3:
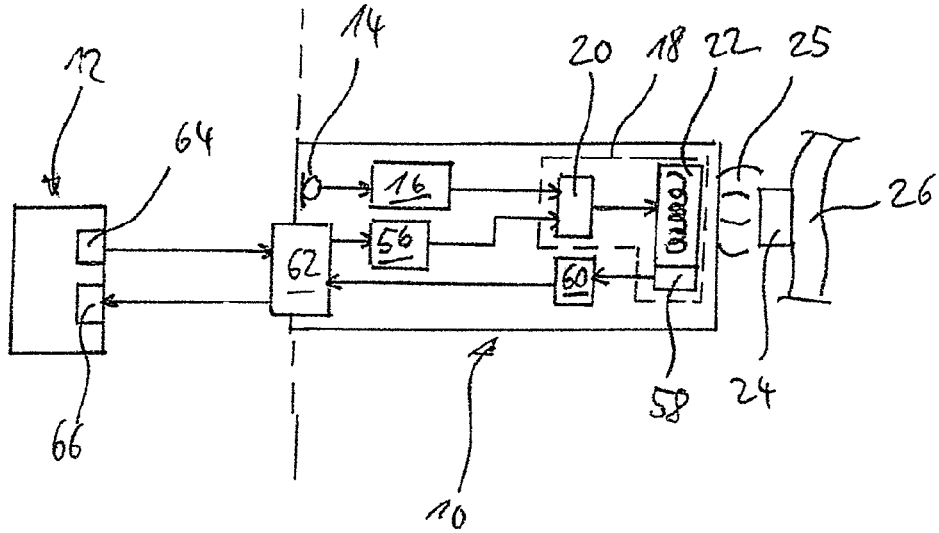
FIG. 3 is a block diagram of an example of a hearing aid according to the invention.

FIG. 3 shows a block diagram of a first embodiment of a hearing aid according to the invention, which comprises an implantable unit 10 and an external device 12, which is to be used by the surgeon during implantation of the implantable unit 10. In the example of FIG. 3 the implantable unit 10 is designed as a fully implantable hearing aid. The implantable unit 10 comprises a microphone arrangement 14 for capturing ambient sound, which may be implanted, for example, in the wall of the patient's ear canal, an audio signal processing unit for processing, i.e. filtering and amplifying, the audio signals captured by the microphone arrangement 14 and a driver unit 18 comprising a driver 20 and an electromagnetic coil 22 for exciting vibration of a permanent magnet 24 fixed at the patient's incus 26 via the magnetic field 25 created by the coil 22 in order to stimulate the patient's hearing according to the audio signals captured by the microphone arrangement 14 and processed by the audio signal processing unit 16. The implantable unit 10 also comprises a rechargeable battery which is charged by an inductive power link to an external charging device to be placed at the patient's skin (not shown in FIG. 3).

Figure 1:
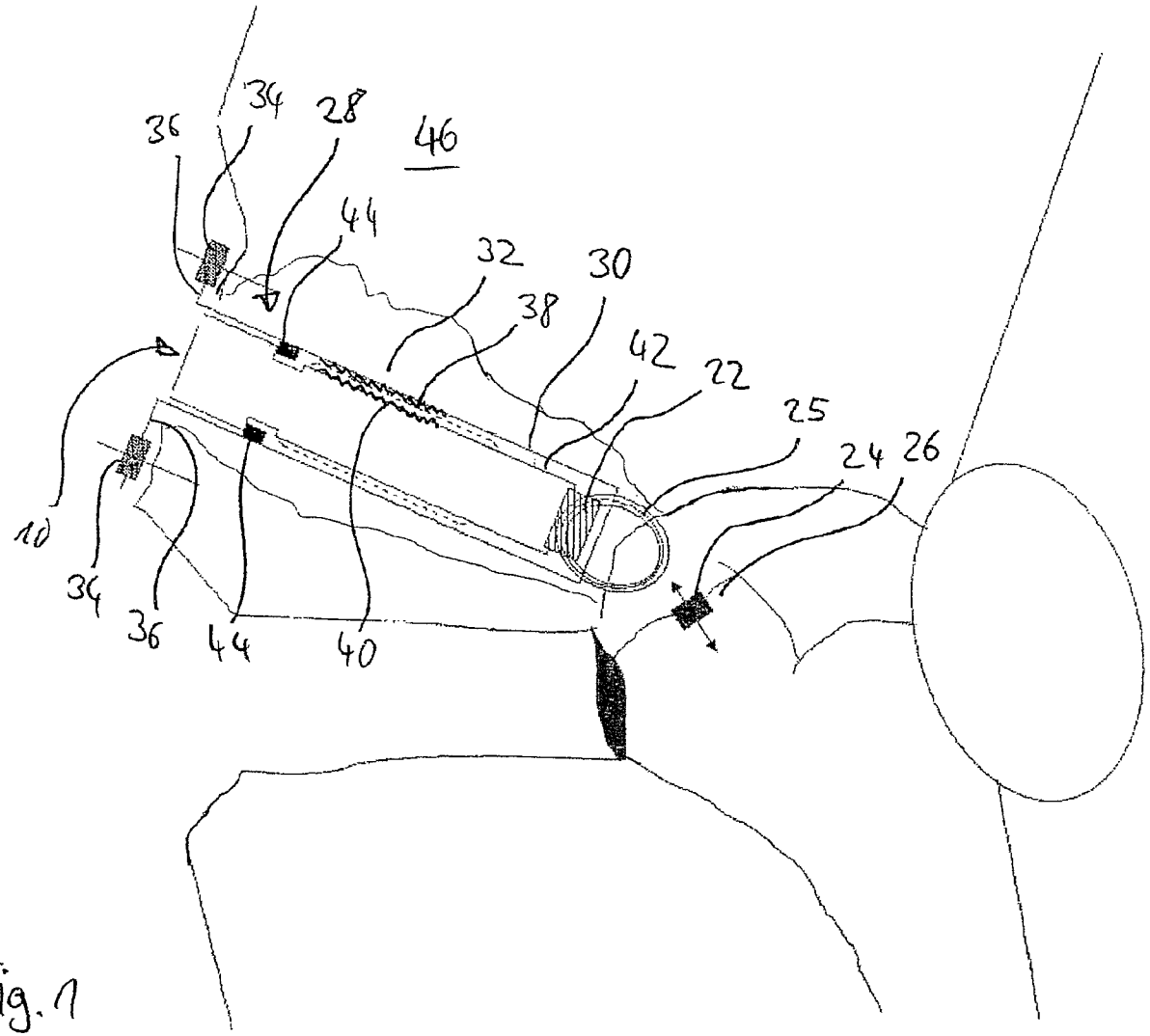
FIG. 1 is a schematic cross-sectional view of an example of a hearing aid according to the invention in an implanted state.

The hearing aid also comprises a fixation system for fixing the implantable unit 10 within the patient's skull. In the example of FIG. 1, the fixation system 28 comprises a tube 30, which is fixed within a cavity 32 drilled into the patient's temporal bone 46. The tube 30 may be fixed at the patient's skull, for example, by screws (not shown) passing through fixation openings 34 of a flange 36 provided at the outer end of the tube 30. The tube 30 is provided at its inner wall with a threading 38 engaging with a threading 40 provided at the outer surface of the housing 42 of the implantable unit 10. Due to the threads 38, 40 the axial position of the implantable unit 10 is adjustable by rotation of the implantable unit 10 relative to the tube by using an appropriate tool (not shown) engaging with the outer end of the implantable unit 10. The fixation system 28 is designed such that the implantable unit 10 can be locked once the final position of the implantable unit 10 has been reached. In the example of FIG. 1, a stopper 44 is provided for this purpose. The stopper 44 is preferably implemented as a screw that locks the thread or as a splint.

Figure 2:
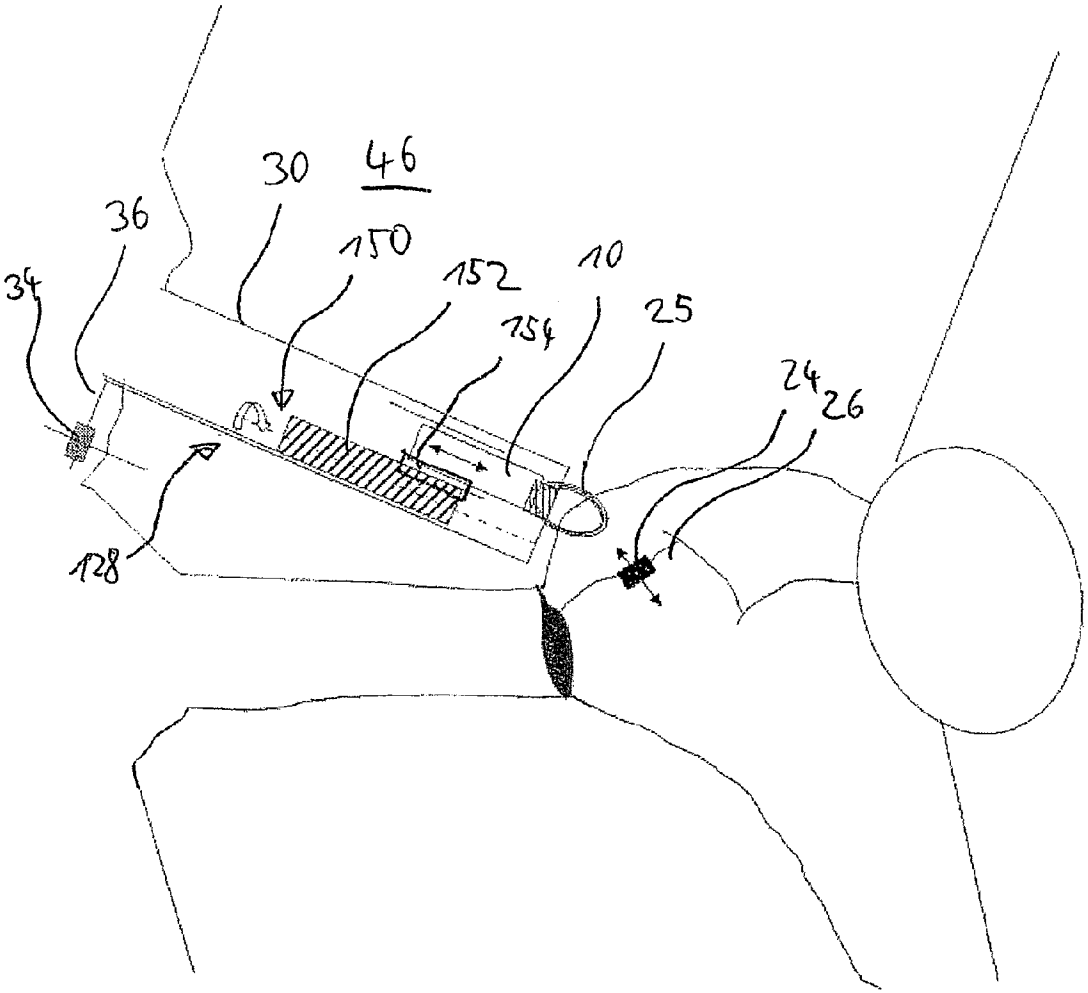
FIG. 2 is a view, like FIG. 1, wherein a modified embodiment is shown.

An alternative embodiment of the fixation system is shown in FIG. 2, wherein a fixation system 128 comprises a spindle drive 150 including an endless screw 152 driving a sledge 154 carrying the implantable unit 10. The spindle drive 150 may be provided as part of a tube 30, which is fixed, as in the embodiment of FIG. 1, within a cavity 32 drilled into the patient's temporal bone 46. In the embodiment of FIG. 2 the axial position of the implantable unit 10 can be adjusted by rotating the endless screw 152 by using an appropriate tool (not shown). Once a final position of the implantable unit 10 is reached it may be locked.

In order to determine the final position of the coil 22, the hearing aid is provided with a distance measurement arrangement for measuring the distance between the coil 22 and the permanent magnet 24, which is based on measurement of the magnetic coupling effects between the coil 22 and the permanent magnet 24. In the example of FIG. 3, the distance measurement arrangement comprises a signal generator 56 for supplying a test signal to the coil driver 20 and a voltage sensor 58 for measuring the response signal of the coil 22 to the test signal. In other words, the distance between the coil 22 and the magnet 24 can be determined by exciting the coil with a test signal and measuring the voltage induced at the coil 22 by the test signal response. Typically, the test signal is a pulse or a chirp. The distance measurement arrangement also comprises an analyzer unit 60 for translating the measured voltage into distance information.

In the example of FIG. 3, the test signal generator 56, the voltage sensor 58 and the analyzer unit 60 are provided as part of the implantable unit 10. The implantable unit 10 comprises an interface 62 to the external device 12 so that the external device 12 may communicate with the distance measurement arrangement. The interface 62 may include a plug connector for enabling a wired connection between the external device 12 and the implantable unit 10, or it may be adapted for establishing a wireless data link between the distance measurement arrangement and the external device 12.

The external device 12 comprises a user interface comprising an element 64, for example a button, which can be operated in order to cause the distance measurement arrangement to initiate a distance measurement and to supply a signal indicative of the measured distance to the external device 12, and an element 66 which supplies information indicative of the measured distance between the coil 22 and the magnet 24 to the surgeon, preferably as an acoustic and/or optical signal. According to a modification of the embodiment of FIG. 3, the analyzer unit 60 and the test signal generator 56 could be provided as part of the external device 12 rather than as part of the implantable unit 10. Usually, the audio signal processing unit 16 will be realized as a digital signal processor (DSP). In this case, the test signal generator 56 and the analyzer unit 60 likewise may be realized by the DSP.

Figure 4:
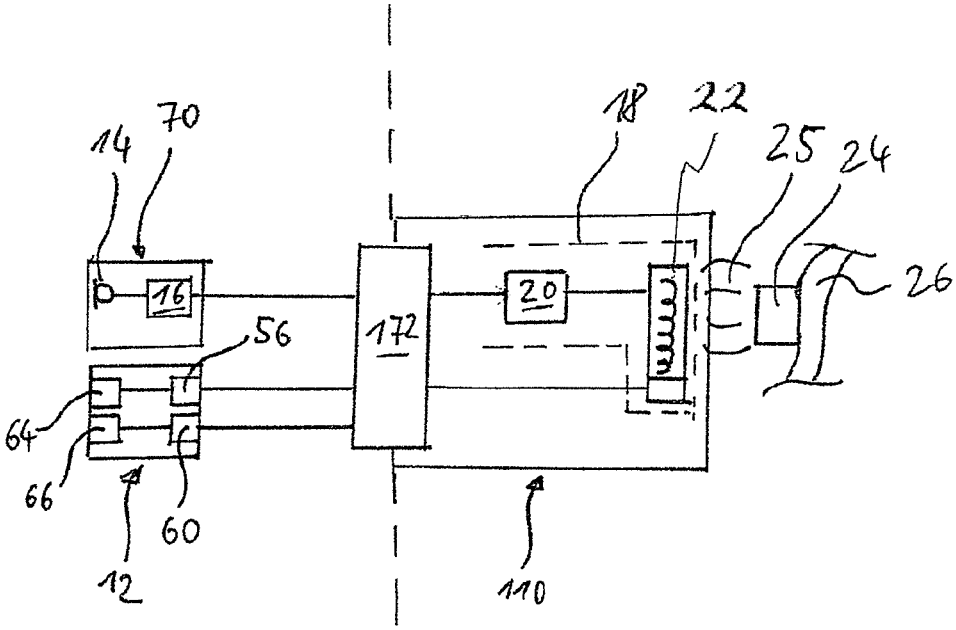
FIG. 4 is a block diagram of an alternative embodiment of a hearing aid according to the invention.

In FIG. 4 an example of a partially implantable hearing aid is shown, comprising an implantable unit 110 including the coil driver 20, the coil 22 and the voltage sensor 58 and an external unit 70 comprising the microphone arrangement 14 and the audio signal processing unit 16. The external unit 70 and the implantable unit 110 are connected via a wireless interface 172 acting as a transcutaneous link, so that the external unit 70 can transmit the processed audio signals to the implantable unit 110. In addition, the wireless interface 172 may act as an inductive power link in order to charge the rechargeable battery of the implantable unit 110 or supply the implant, in case there is no implantable battery.

The interface 172 is also used for communication between the external device 12 and the implantable unit 110 for realizing the distance measurement function of the hearing aid. In the embodiment of FIG. 4, the test signal generator 56 and the analyzer unit 60 are provided as part of the external device 12.

Usually, the interface 172 is designed such that it creates an inductive link between an implanted coil and an external coil to be placed close to the patient's skin. Such transcutaneous inductive links are known in the art.

The external unit 70 may be designed as a "button", which is placed close to the ear at the patient's skin, usually by implanted magnets which interact with magnets provided in the button.

The external device 12 could be provided as a separate unit or it may be integrated within the external unit 70. In this case, the test signal generator 56, the analyzer unit 60 and the audio signal processing unit 16 may be realized by the same DSP.

Figure 5:
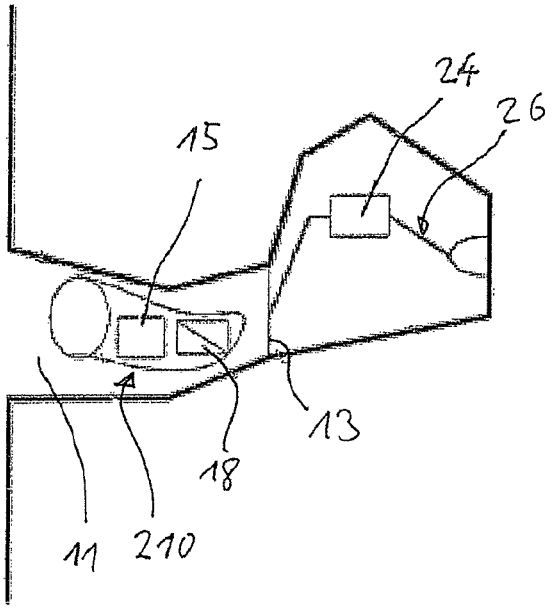
FIG. 5 is a schematic cross-sectional view of an example of a hearing aid according another alternative embodiment of the invention.
Figure 6:
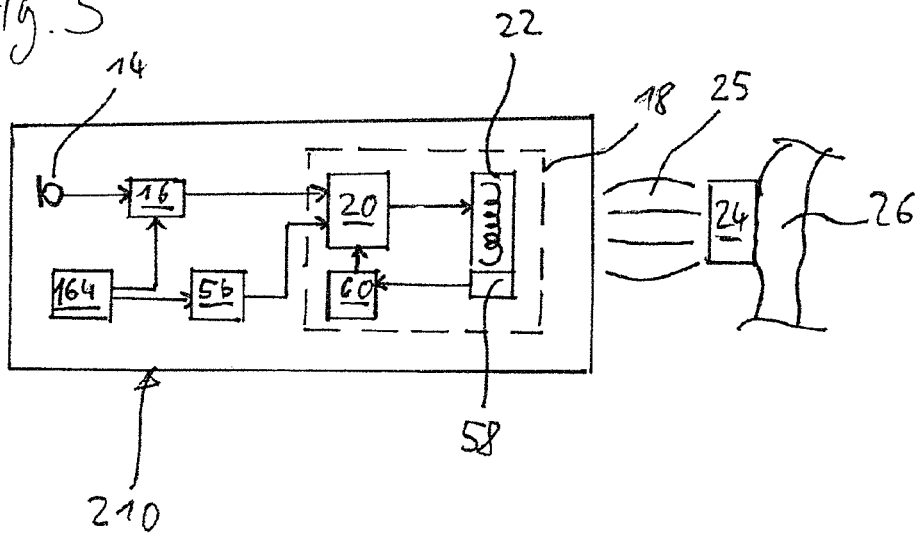
FIG. 6 is an example of a block diagram of the hearing aid of FIG. 5.

In FIGS. 5 and 6, an alternative embodiment of the invention is shown, wherein the implantable unit 10, 110 is replaced by an ITE device 210 which is to be inserted into the ear canal 11 and which is similar to an ITE (in-the-ear) hearing aid. The device 210 comprises a microphone arrangement 14 for capturing audio signals from ambient sound, an audio signal processing unit 16 and driver unit 18 comprising a driver 20 and an electromagnetic coil 22 for exciting vibration of a permanent magnet 24 fixed at the patient's incus 26 via the magnetic field 25 created by the coil 22 and extending across an eardrum 13 in order to stimulate the patient's hearing according to the audio signals captured by the microphone arrangement 14 and processed by the audio signal processing unit 16. Such type of partially implantable hearing aid is described, for example, in U.S. Pat. No. 4,957,478.

The hearing stimulation provided by the magnet 24 depends on the distance between the coil 22 and the magnet 24. However, it is very difficult, if not impossible, to precisely control the position of the ITE device 210 in the ear canal 11. Hence, the practical performance of hearing aid may be significantly deteriorated by deviations of the actual position of the ITE device 210 from the target position. In order to overcome this problem, the ITE device 210 is adapted to measure the magnetic coupling between the coil 22 and the permanent magnet 24 and to determine the deviation of the measured magnet coupling from a pre-defined reference value in order to adjust the input signal to the coil 22 as provided by the coil driver 20.

To this end, the ITE device 210 includes a measurement arrangement comprising a signal generator 56 for supplying a test signal to the coil driver 20 and a voltage sensor 58 for measuring the response signal of the coil 22 to the test signal. In other words, the coupling between the coil 22 and the magnet 24 can be determined by exciting the coil 22 with a test signal and measuring the voltage induced at the coil 22 by the test signal response. Typically, the test signal is a pulse or a chirp. The measurement arrangement also comprises an analyzer unit 60 for translating the measured voltage into magnet coupling information, in particular into the deviation of the actual magnetic coupling from a reference value. The analyzer unit 60 supplies a corresponding signal to the coil driver 20 in order to adjust the input signal to the coil 22 accordingly. For example, if the magnet coupling is found to be too weak (as the result of a too large distance between the coil 22 and the magnet 24), the gain applied to the audio signals received from the audio signal processing unit 16 will be increased, so that strength of the magnetic field generated by the coil 22 will increase accordingly. Thus, the actually perceived hearing stimulation can be made more or less independent from the actual position of the ITE device 210.

The audio signal processing unit 16, the analyzer unit 60 and the test signal generator 56 may be realized by a DSP 15.

The ITE device 210 also may include a user interface 164, which usually will be realized by a remote control (not shown), in order to enable user control of the hearing aid, such as on/off, volume up/down, selection of the hearing aid program. The user interface also may serve to initiate a measurement of the magnetic coupling by the measurement arrangement.

Such functionality concerning the adjustment of the magnetic field strength according to the measured magnetic coupling in principle also could be implemented as an additional feature in the distance measurement arrangement of hearing aids comprising an implantable driver unit 18, as the systems shown in FIGS. 1 to 4. Such functionality could be helpful in case that adjustment of the distance between coil 22 and magnet 24 to the optimal distance is not (fully) successful. However, due to the limited power budget, the preferred option for implanted devices is to use the measured magnetic coupling primarily for manual distance adjustment.

What is claimed is:

1. A hearing aid comprising:

a permanent magnet adapted to be fixed at a patient's incus;

an audio signal source;

an audio signal processing unit for processing audio signals from the audio signal source;

a driver unit including a coil for generating a magnetic field for vibrating the permanent magnet according to the processed audio signals in order to stimulate the patient's hearing; and a measurement arrangement configured for measuring a magnetic coupling between the coil and the permanent magnet in order to adjust the position of the coil or processed audio signals to the coil provided by the driver unit, wherein the driver unit forms part of an implantable unit which includes a fixation system for fixing the coil of the driver unit to a patient's skull at a first position relative to the permanent magnet;

the implantable unit includes means for manual adjustment of the coil from the first position to a final position; and the measurement arrangement is configured to act as a distance measurement arrangement for measuring a distance between the coil and the permanent magnet in order to select the final position of the coil, wherein the distance measurement arrangement comprises a signal generator configured for supplying a test signal to the driver unit and means for measuring a response signal of the coil to the test signal.

2. The hearing aid of claim 1, wherein the test signal is a pulse or a chirp.

3. The hearing aid of claim 1, wherein the means for measuring the response signal of the coil to the test signal include a voltage sensor.

4. The hearing aid of claim 1, wherein the implantable unit comprises the means for measuring a response signal of the coil to the test signal.

5. The hearing aid of claim 4, wherein:

the implantable unit comprises an interface for connection to an external device to be used by a surgeon; and the external device is adapted to communicate with the distance measurement arrangement and comprises means for supplying information indicative of the measured distance between the coil and the permanent magnet to the surgeon.

6. The hearing aid of claim 5, wherein the implantable unit comprises the distance measurement arrangement.

7. The hearing aid of claim 6, wherein the external device comprises means for causing the distance measurement unit to initiate a distance measurement and to supply a signal indicative of the measured distance to the external device.

8. The hearing aid of claim 5, wherein the external device comprises a test signal generator.

9. The hearing aid of claim 8, wherein the external device comprise means for transforming the response signal of the coil to the test signal into information indicative of effectiveness of the magnetic coupling between the coil and the permanent magnet.

10. The hearing aid of claim 5, wherein the means for supplying information indicative of the measured distance between the coil and the permanent magnet are adapted to provide an acoustic and/or optical signal.

11. The hearing aid of claim 5, wherein the interface is adapted to establish a wireless data link between the distance measurement arrangement and the external device.

12. The hearing aid of claim 1, wherein the fixation system comprises threads.

13. The hearing aid of claim 12, wherein:

the fixation system comprises a tube adapted to be fixed at a patient's skull within a cavity drilled into the patient's temporal bone;

the tube comprises an inner thread engaging with an outer thread provided at an outer surface of a housing of the implantable unit; and an axial position of the implantable unit is adjustable by rotation of the implantable unit relative to the tube.

14. The hearing aid of claim 13, wherein the fixation system comprises means for locking the implantable unit in the final position of the coil.

15. The hearing aid of claim 14, wherein the locking means comprise a stopper provided at the tube.

16. The hearing aid of claim 12, wherein the fixation system comprises a spindle drive for axially adjusting a position of the implantable unit within a cavity drilled into the patient's temporal bone, the spindle drive comprising means adapted for being fixed to the patient's skull and an endless screw driving a sledge carrying the implantable unit.

17. The hearing aid of claim 1, wherein the audio signal source is a microphone arrangement which is adapted to be worn at the or at least partially within a user's ear or which is implantable.

18. The hearing aid claim 1, wherein the implantable unit includes the audio signal processing unit.

19. The hearing aid of claim 1, wherein the hearing aid comprises an external unit adapted to be worn at or at least partially within the patient's ear, which is adapted to communicate with the implantable unit via a transcutaneous link.

20. The hearing aid of claim 19, wherein the external unit comprises a microphone arrangement.

21. The hearing aid of claim 19, wherein the external unit comprises the audio signal processing unit.

22. The hearing aid of claim 1, wherein:

the driver unit forms part of an in-the-ear (ITE) device which is adapted to be inserted into a user's ear canal; and a driver assembly includes means for adjusting the processed audio signals to the coil provided by the driver unit according to the measured magnetic coupling between the coil and the permanent magnet.

23. The hearing aid of claim 22, wherein the driver unit is adapted to adjust a coil current and/or a coil voltage.

24. The hearing aid of claim 22, wherein the ITE device includes the audio signal source and the audio signal processing unit.

* * * * *